US008192252B2

(12) United States Patent
Tsurui

(10) Patent No.: US 8,192,252 B2
(45) Date of Patent: Jun. 5, 2012

(54) SMALL TEST PIECE POLISHING APPARATUS

(75) Inventor: Takafumi Tsurui, Hyogo (JP)

(73) Assignee: Kobe Material Testing Laboratory Co., Ltd., Hyogo (JP)

( * ) Notice: Subject to any disclaimer, the term of this patent is extended or adjusted under 35 U.S.C. 154(b) by 485 days.

(21) Appl. No.: 12/449,630

(22) PCT Filed: Aug. 24, 2007

(86) PCT No.: PCT/JP2007/066421

§ 371 (c)(1),
(2), (4) Date: Aug. 18, 2009

(87) PCT Pub. No.: WO2008/111243

PCT Pub. Date: Sep. 18, 2008

(65) Prior Publication Data

US 2010/0087126 A1 Apr. 8, 2010

(30) Foreign Application Priority Data

Mar. 15, 2007 (JP) ..... 2007-067304

(51) Int. Cl.
*B24B 21/02* (2006.01)

(52) U.S. Cl. ..... 451/300; 451/168; 451/49

(58) Field of Classification Search ..... 451/296, 451/300, 305, 307, 311, 310, 49, 51, 54, 451/59, 167, 168
See application file for complete search history.

(56) References Cited

U.S. PATENT DOCUMENTS

| | | | | |
|---|---|---|---|---|
| 5,727,989 | A * | 3/1998 | Ohno et al. | 451/41 |
| 5,733,181 | A * | 3/1998 | Hasegawa et al. | 451/168 |
| 5,913,716 | A * | 6/1999 | Mucci et al. | 451/59 |
| 6,220,940 | B1 * | 4/2001 | Johnson | 451/59 |
| 6,544,108 | B2 * | 4/2003 | McCoy | 451/49 |

* cited by examiner

*Primary Examiner* — Dung Van Nguyen
(74) *Attorney, Agent, or Firm* — Bacon & Thomas, PLLC

(57) ABSTRACT

A small test piece polishing apparatus is provided which is less likely to bend or damage a small test piece, which is superior in working efficiency, and which ensures uniform quality for the small test pieces produced. The small test piece polishing apparatus 1 for polishing a surface of a small test piece 3 having a circular cross section using a string-type member 13 includes string-type member delivery/recovery means 10, abrasive applying means 20, holding/rotating means 30, and pressing/scanning means 40. The abrasive applying means 20 applies an abrasive to the string-type member delivered by the string-type member delivery/recovery means 10. Thereafter, the pressing/scanning means 40 presses the string-type member 13 applied with the abrasive against the small test piece 3 held and rotated by the holding/rotating means 30 to perform scanning, to thereby polish the small test piece 3.

4 Claims, 5 Drawing Sheets

SMALL TEST PIECE POLISHING APPARATUS

TECHNICAL FIELD

The present invention relates to a small test piece polishing apparatus which is for polishing a surface of a rod-type member having a circular cross section to produce a small test piece.

BACKGROUND ART

As a small test piece polishing apparatus for producing a small test piece by polishing a surface of a rod-type member having a circular cross section, there is conventionally proposed a grinding device for a test piece as disclosed in Patent Document 1 below.

Patent Document 1: Japanese Patent Application Laid-Open No. 2001-315043

DISCLOSURE OF THE INVENTION

Problems to be Solved by the Invention

The test piece grinding device disclosed in Patent Document 1 above uses a columnar grinding wheel to grind a workpiece, to advantageously leave grinding traces parallel to an axial direction of the test piece and achieve uniform surface roughness for the test piece.

With the test piece grinding device of Patent Document 1, however, the grinding wheel is pressed against the workpiece for grinding, which may easily bend or damage the test piece particularly in the case where the test piece being polished is a small test piece.

In view of the foregoing, an object of the present invention is to solve the conventional problems as described above and to provide a small test piece polishing apparatus which is less likely to bend or damage the small test piece, which achieves high working efficiency, and which ensures uniform quality for the small test pieces produced.

Means for Solving the Problems

To achieve the above object, a small test piece polishing apparatus according to the present invention has a first feature that it is for polishing a surface of a small test piece having a circular cross section using a string-type member, and it includes: string-type member delivery/recovery means for delivering and recovering a string-type member; abrasive applying means for applying an abrasive to the string-type member delivered; holding/rotating means for holding and rotating a small test piece to be polished; and pressing/scanning means for pressing the string-type member applied with the abrasive against a surface of the small test piece being rotated, to perform scanning.

In addition to the first feature described above, the small test piece polishing apparatus of the present invention has a second feature that, for applying the abrasive to the string-type member, the abrasive applying means moistens the string-type member before applying the abrasive to the string-type member.

In addition to the first or second feature described above, the small test piece polishing apparatus of the present invention has a third feature that the pressing/scanning means presses the string-type member applied with the abrasive against the small test piece at a right angle with respect to an axial direction of the small test piece, and causes the string-type member applied with the abrasive to oscillate in the axial direction of the small test piece while being pressed against the small test piece.

Effects of the Invention

According to the small test piece polishing apparatus recited in claim 1, the string-type member delivery/recovery means for delivering and recovering the string-type member is provided, which ensures smooth delivery and recovery of the string-type member. Further, the abrasive applying means for applying an abrasive to the string-type member delivered is provided, which can surely apply the abrasive to the string-type member. Furthermore, the holding/rotating means for holding and rotating the small test piece to be polished is provided, which ensures that the small test piece to be polished is surely held and is rotated in that state. Still further, the pressing/scanning means for pressing the string-type member applied with the abrasive against the surface of the small test piece being rotated and performing scanning is provided, so that the string-type member applied with the abrasive is surely brought into contact with the surface of the small test piece being rotated. Furthermore, scanning in this state ensures precise and accurate polishing of a surface-hardened layer which has been created in the portion to be polished during rough grinding.

According to the small test piece polishing apparatus recited in claim 2, in addition to the above-described effects obtained by the configuration recited in claim 1, the abrasive applying means is configured to moisten the string-type member before applying the abrasive to the string-type member. By moistening the string-type member, the abrasive can be easily applied to the string-type member. This ensures efficient application of the abrasive to the string-type member.

According to the small test piece polishing apparatus recited in claim 3, in addition to the above-described effects obtained by the configuration recited in claim 1 or 2, the pressing/scanning means is configured to press the string-type member applied with the abrasive against the small test piece at a right angle with respect to the axial direction of the small test piece, and cause the string-type member applied with the abrasive to move to and fro in the axial direction of the small test piece while being pressed against the small test piece. This enables polishing in the state where the string-type member applied with the abrasive is pressed against the small test piece constantly at a right angle with respect to the axial direction of the small test piece, thereby realizing an evenly polished surface.

DESCRIPTION OF THE REFERENCE CHARACTERS

Figure 1:
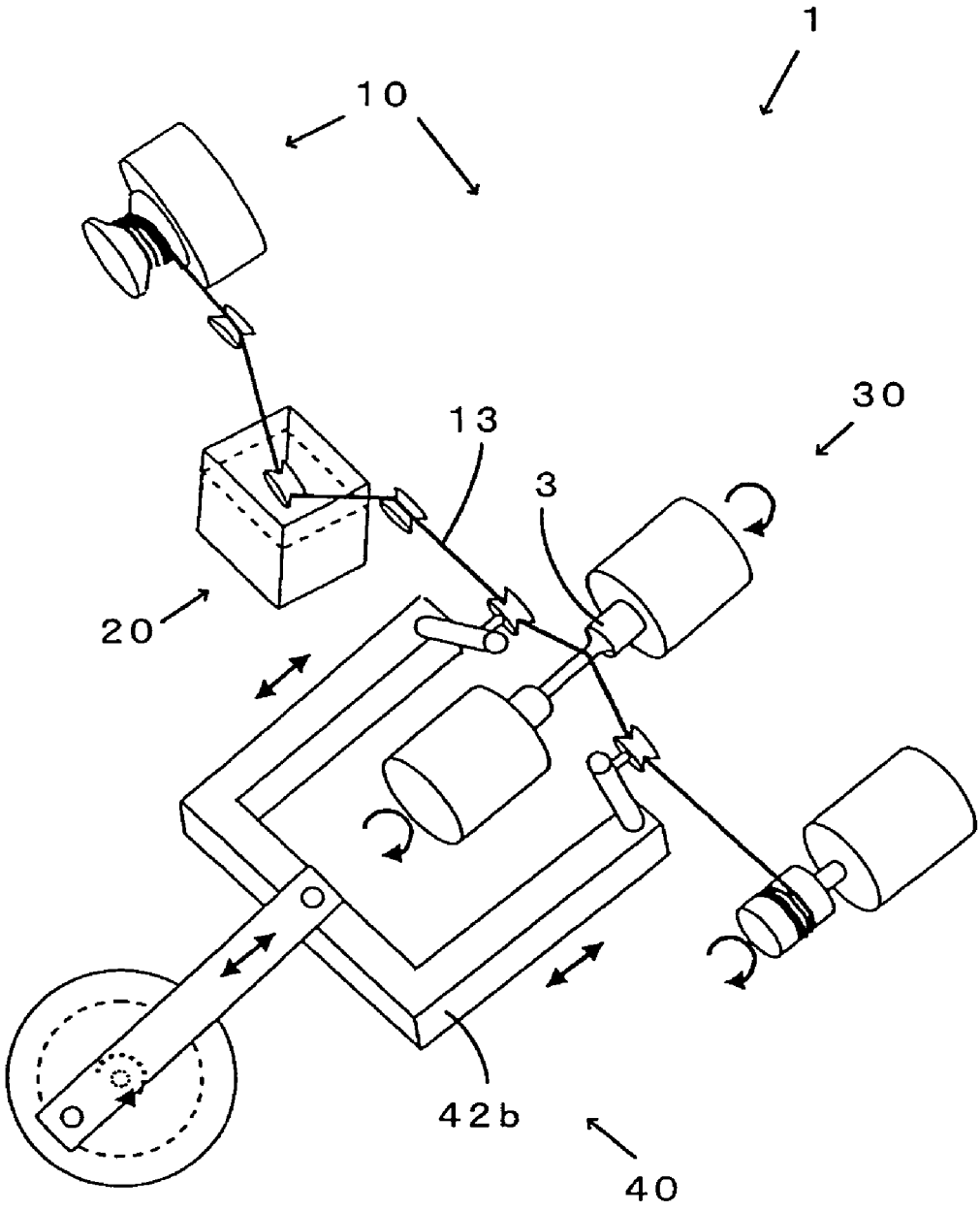
FIG. 1 is a perspective view illustrating a basic structure and functions of a small test piece polishing apparatus according to the present invention.

1 small test piece polishing apparatus
2 base
3 small test piece
10 string-type member delivery/recovery means
11 delivery portion
12 recovery portion
13 string-type member
20 abrasive applying means
21 liquid container
22 abrasive container
23 fixed pulley
30 holding/rotating means
31 holding portion
32 rotating portion
32*a* motor
32*b* lower rotating roller
32*c* upper rotating roller
40 pressing/scanning means
41 motor
42 scanning arm
42*a* connecting rod
42*b* arm body
42*c* end arm
42*d* pressure roller mounting arm
43 pressure roller Best Modes for Carrying Out the Invention Hereinafter, an embodiment of the small test piece polishing apparatus according to the present invention will be described with reference to the following drawings.

Figure 2:
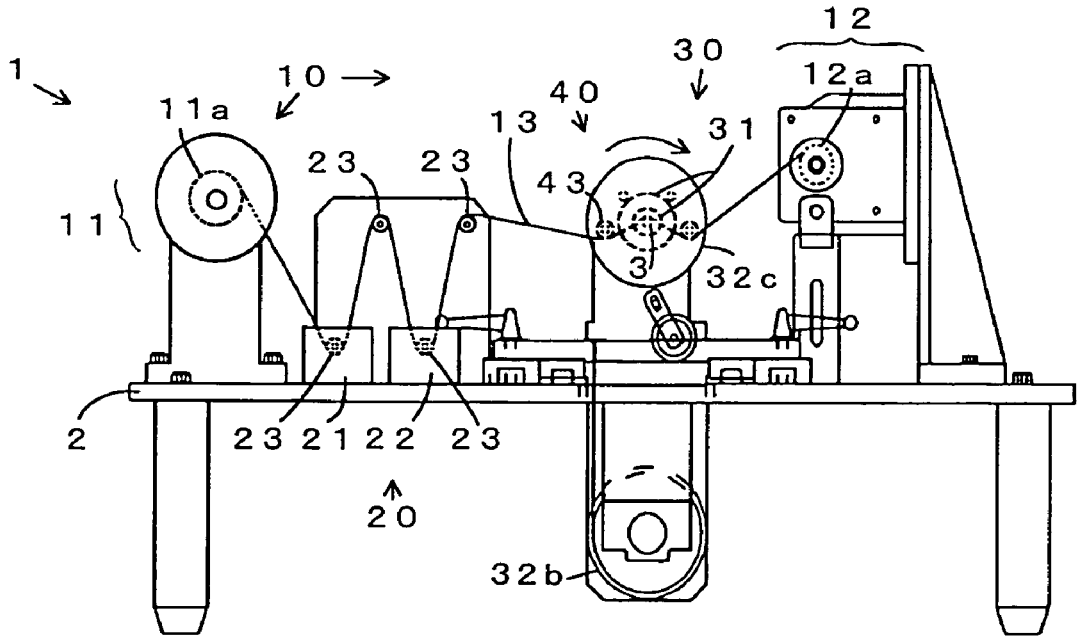
FIG. 2 is a front view schematically illustrating the structure of the small test piece polishing apparatus according to an embodiment of the present invention.
Figure 3:
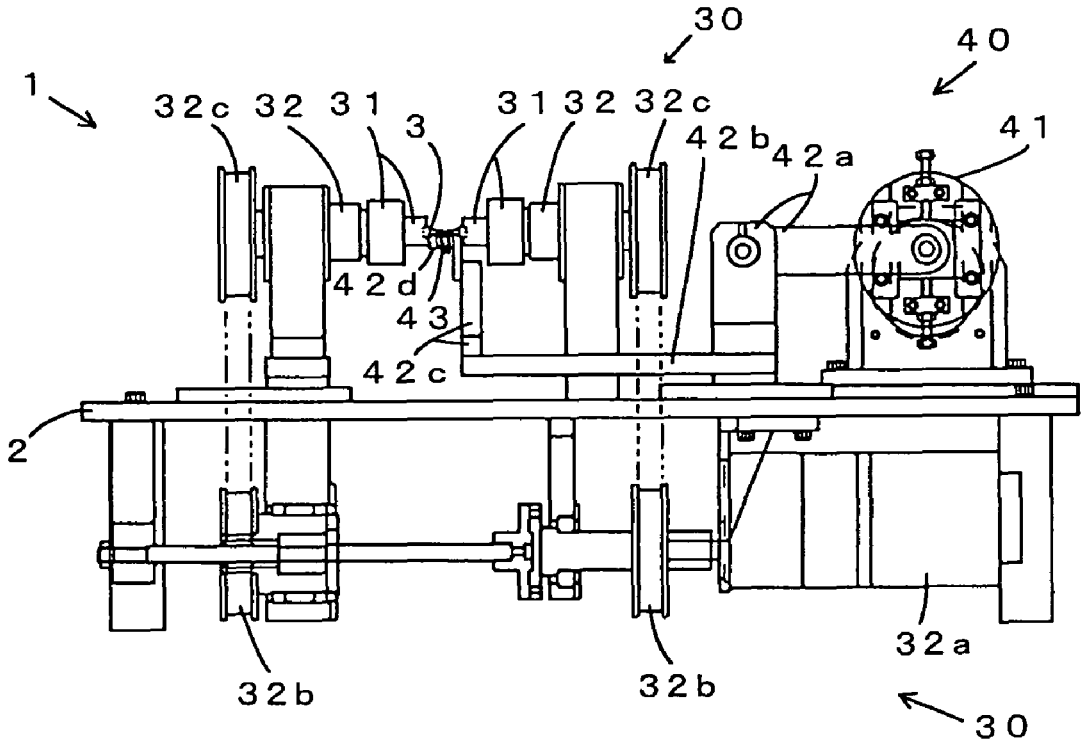
FIG. 3 is a right-side view schematically illustrating the structure of the small test piece polishing apparatus according to the embodiment of the present invention.
Figure 4:
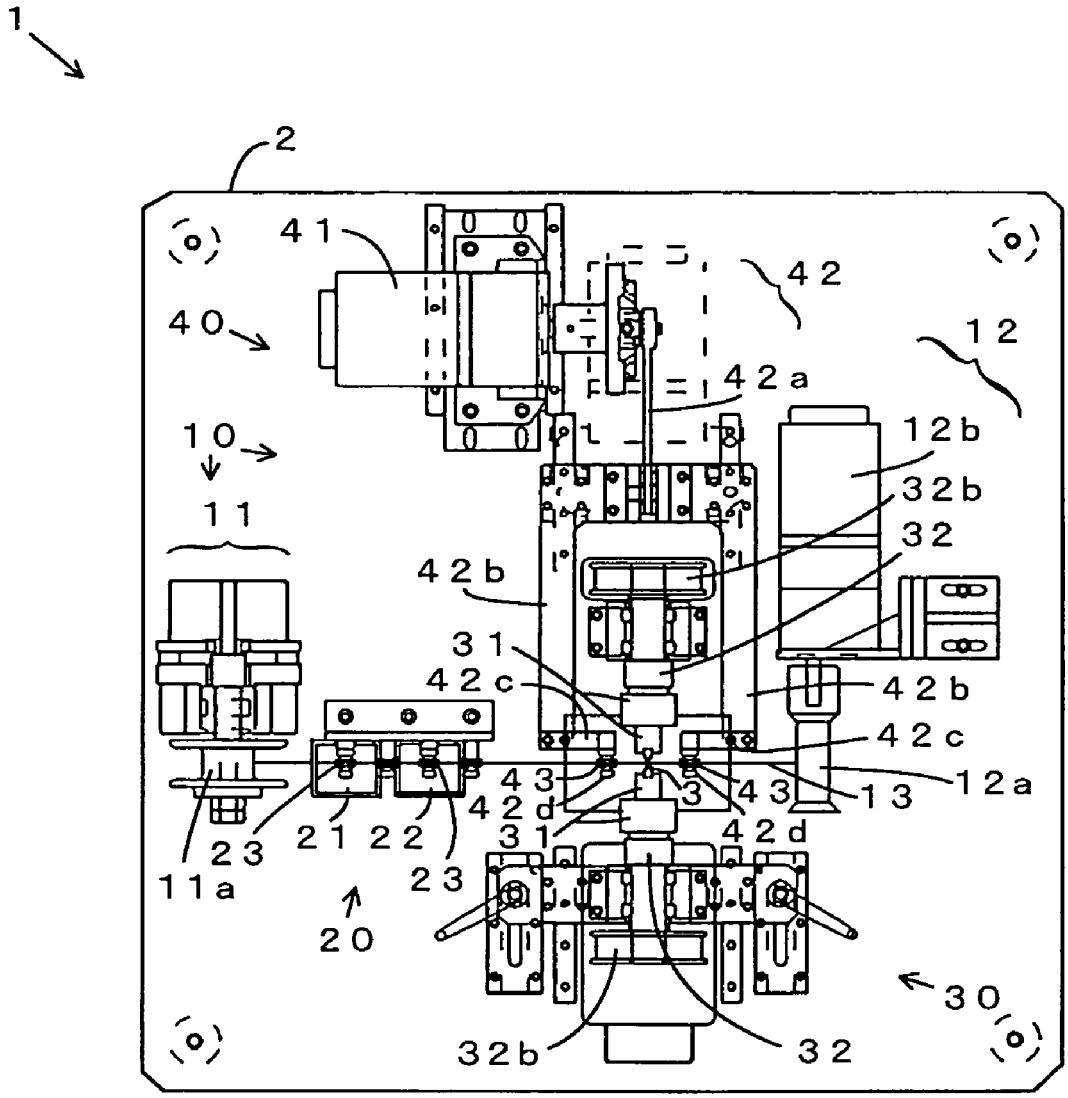
FIG. 4 is a plan view schematically illustrating the structure of the small test piece polishing apparatus according to the embodiment of the present invention.
Figure 5:
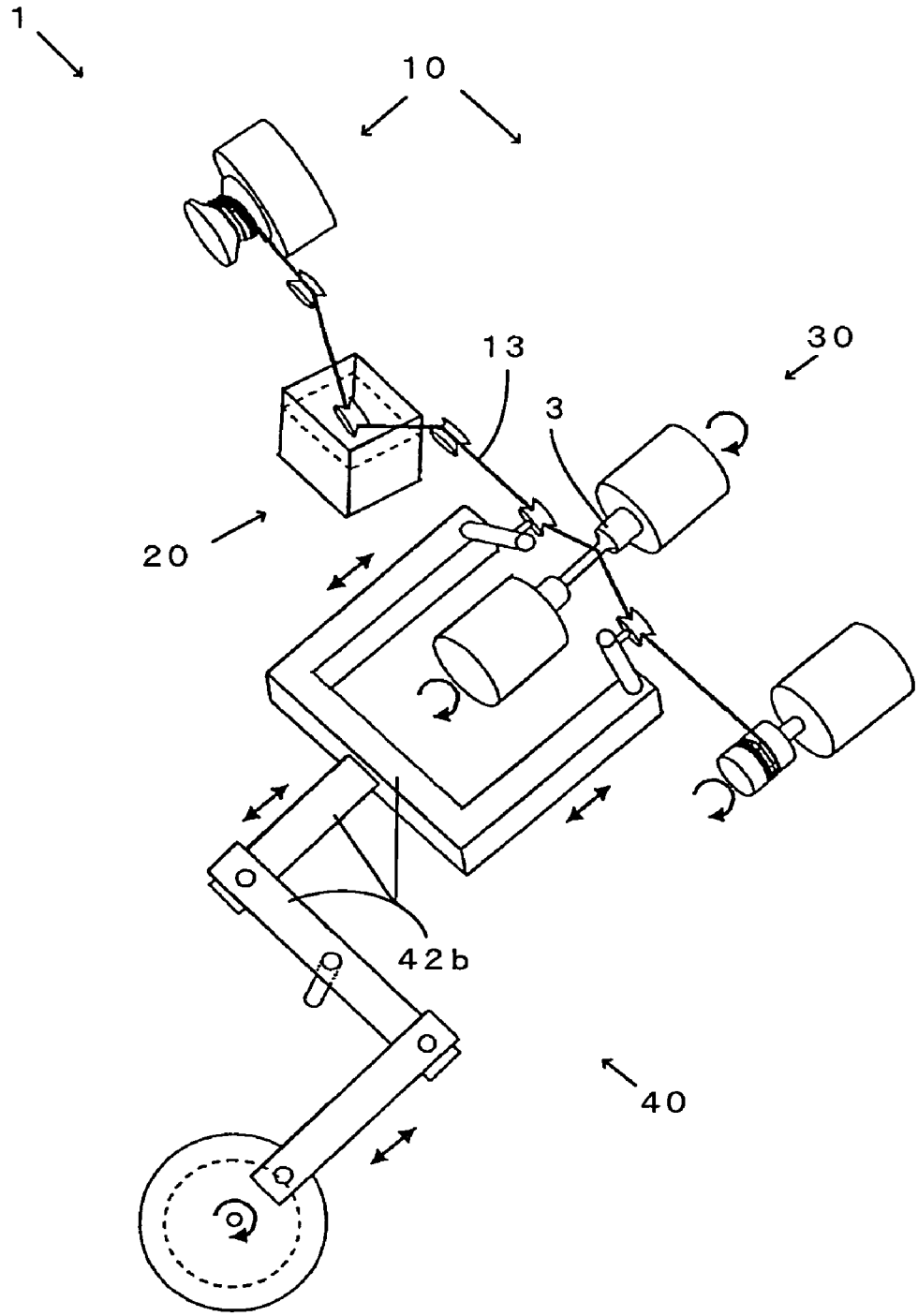
FIG. 5 is a perspective view illustrating a modification of the arm body in the small test piece polishing apparatus shown in FIG. 1.

FIG. 1 is a perspective view illustrating a basic structure and functions of the small test piece polishing apparatus according to the present invention. FIG. 2 is a front view schematically illustrating the structure of the small test piece polishing apparatus according to an embodiment of the present invention. FIG. 3 is a right-side view schematically illustrating the structure of the small test piece polishing apparatus according to the embodiment of the present invention. FIG. 4 is a plan view schematically illustrating the structure of the small test piece polishing apparatus according to the embodiment of the present invention. FIG. 5 is a perspective view illustrating a modification of the arm body in the small test piece polishing apparatus shown in FIG. 1.

Firstly, the basic structure and functions of a small test piece polishing apparatus 1 according to the present invention will be described with reference to FIG. 1.

The small test piece polishing apparatus 1 is an apparatus for polishing a portion to be polish-finished of a roughly ground small test piece 3 to thereby produce the small test piece 3. The small test piece polishing apparatus 1 is constituted by: string-type member delivery/recovery means 10, abrasive applying means 20, holding/rotating means 30, and pressing/scanning means 40. According to this apparatus, the abrasive applying means 20 firstly applies an abrasive to a string-type member 13 delivered by the string-type member delivery/recovery means 10. Thereafter, the pressing/scanning means 40 presses the string-type member 13 applied with the abrasive against the small test piece 3 held and rotated by the holding/rotating means 30, and performs scanning, to thereby polish the small test piece 3.

Now, the embodiment of the small test piece polishing apparatus 1 according to the present invention shown in FIG. 1 will be described in more detail with reference to FIGS. 2 to 4.

The small test piece polishing apparatus 1 is constituted by: the string-type member delivery/recovery means 10, the abrasive applying means 20, the holding/rotating means 30, and the pressing/scanning means 40, which are mounted to a base 2.

The string-type member delivery/recovery means 10 is means for delivering and recovering a string-type member. This string-type member delivery/recovery means 10 is made up of a delivery portion 11, a recovery portion 12, and the string-type member 13, as shown in FIGS. 2 and 4.

The delivery portion 11 is a portion for delivering the string-type member 13. As shown in FIG. 4, the delivery portion 11 has a roller 11*a* around which the string-type member 13 is wound. The string-type member 13 is delivered from the delivery portion 11 as the recovery portion 12 reels up the string-type member 13. The roller 11*a* is provided with a tension-adjusting variable brake. This allows the tension of the string-type member 13 extending from the delivery portion 11 to the recovery portion 12 to be kept constantly at a fixed level, whereby the small test piece 3 can be polished uniformly.

The recovery portion 12 is a portion for recovering the string-type member 13 delivered from the delivery portion 11. As shown in FIG. 4, the recovery portion 12 has a roller 12*a* for winding up the string-type member 13 and a motor 12*b* attached to the roller 12*a*. As the roller 12*a* is rotated by the motor 12*b*, the string-type member 13 is wound up around the roller for recovery. The rotational speed of the motor is decreased to a predetermined level by a speed reducer.

It is noted that the string-type member 13 does not necessarily have to be wound up around the roller; it may be recovered in any manner. For example, an upper roller and a lower roller may be provided, and the string-type member 13 may be delivered by the frictional force of the rollers so as to be recovered into a container.

The string-type member 13 is a member which is applied with an abrasive and used for polishing a surface of the small test piece 3.

The string-type member may be a thread, for example. The thread is small in mass, in thickness, and in width, so that it applies only a small load onto a contact surface with the small test piece 3 even if the thread is pressed against the small test piece 3 for polishing. Further, the thread is flexible, so that when the thread is pressed against the small test piece 3, it becomes flat, whereby the contact area increases. Accordingly, the vertical load applied onto the contact point with the small test piece 3 can be dispersed and further decreased. As a result, the small test piece polishing apparatus 1 which would not bend or damage the small test piece 3 is achieved, and fine polishing is realized. A surface-hardened layer or a strained layer created through rough grinding of the small test piece 3 can be scraped off on the order of microns in thickness. For the thread, natural fiber, synthetic fiber, or any other thread may be used as long as it is strong enough not to be cut easily during polishing. Further, the thread may have any structure, as long as an abrasive can easily be applied thereto. While porous thread, hollow thread, spiral thread, fibrous thread, and non-woven thread may be used for the thread, pure cotton leveling string (so-called "kite string") is particularly desirable.

The pure cotton leveling string is made up of a bundle of threads twisted together, so that it has tensile strength greater than that of a normal thread, surely preventing the threads from being cut during polishing. Further, it can entrap air between the threads tied in a bundle, so that the air functions as cushioning to further improve the flexibility of the threads, and accordingly, it is possible to achieve the small test piece polishing apparatus 1 which is still less likely to bend or damage the small test piece 3. Furthermore, with the plurality of threads twisted together and bundled, the surface area is larger than in the case of a single thread. In addition, the abrasive can enter the gaps between the threads, thereby ensuring very efficient polishing.

The thread may have a cross section of, e.g., circular, rectangular, or other shape. The number of threads is not limited to that in the present embodiment.

Providing the string-type member delivery/recovery means 10 as descried above ensures smooth delivery and recovery of the string-type member 13, and it is also possible to achieve the small test piece polishing apparatus 1 in which the string-type member 13 would not likely be cut, while maintaining constant tensile force.

The abrasive applying means 20 is means for applying an abrasive onto the string-type member 13. As shown in FIG. 2, the abrasive applying means 20 is arranged between the delivery portion 11 and the holding/rotating means 30, and is made up of a liquid container 21, an abrasive container 22, and pulleys 23.

The liquid container 21 is a container for a liquid which is used to moisten the string-type member 13. As shown in FIG. 2, the liquid container 21 is placed upstream of the abrasive container 22 in the traveling direction of the string-type member 13. The liquid may be changed as appropriate depending on the material of the string-type member 13. For example, water may be used.

Moistening the string-type member 13 with a liquid in this way allows the subsequent step of applying the powdery abrasive to be performed efficiently. Further, it can cool down the frictional heat that would be generated when polishing, and thus can prevent deformation of the small test piece 3 due to the frictional heat. Furthermore, the liquid serves as a lubricant during polishing, and at the same time, fine polishing debris generated during polishing are adhered to and carried away by the moistened string-type member 13. Particularly in the case where the string-type member 13 is a thread, it can be moistened effectively, because the thread is superior in terms of absorbing a liquid.

The abrasive container 22 is a container for a powdery abrasive which is to be applied to the string-type member 13. As shown in FIG. 2, the abrasive container 22 is positioned downstream of the liquid container 21 in the traveling direction of the string-type member 13. While alumina fine powder is used as the abrasive, not limited thereto, any of natural abrasives including diatomaceous earth or artificial abrasives including silicon carbide may be used. The particle size may also be changed in accordance with the desired degree of polishing.

The pulley 23 is a member for changing the traveling direction of the string-type member 13. The traveling direction of the string-type member 13 is changed by causing the string-type member 13 to pass over and below the neighboring pulleys 23 alternately.

As shown in FIG. 2, the pulleys 23 are placed in and out of the liquid container 21 and the abrasive container 22, and the string-type member 13 is passed therethrough. With this configuration, while the string-type member 13 delivered is being reeled up along the pulleys 23, the string-type member 13 firstly passes through the liquid container 21 where the string-type member 13 is moistened, and it then passes through the abrasive container 22 where the powdery abrasive is applied to the surface of the moistened string-type member 13 efficiently.

By providing the abrasive applying means 20 as described above, it is possible to efficiently apply the abrasive to the string-type member 13.

The holding/rotating means 30, which is arranged on and beneath the base 2 as shown in FIGS. 2 and 3, is means for holding and rotating the small test piece 3. The holding/rotating means 30 is made up of a holding portion 31 and a rotating portion 32, as shown in FIG. 3.

The holding portion 31 is a portion for holding the small test piece 3. As shown in FIG. 2, the holding portion 31 is made up of a pair of holding elements configured to hold respective ends of the small test piece 3. The pair of holding elements is attached to the rotating portion 32. With this configuration, the small test piece 3 can be held firmly by the pair of holding elements, and as the rotating portion 32 rotates, the pair of holding elements rotates synchronously, to thereby rotate the small test piece 3 that the pair of holding elements is holding. The rotation direction of the small test piece 3 is identical to the traveling direction of the string-type member 13 at the contact surface with the string-type member 13, as shown in FIG. 1. This configuration can prevent the undesirable event that, in the direction perpendicular to the axial direction of the small test piece 3, the string-type member 13 applied with the abrasive and the small test piece 3 rub against each other to cause friction. As a result, it is possible to prevent polishing traces from being left on the small test piece 3 in the direction perpendicular to the axial direction thereof. Accordingly, breaks or cracks of the small test piece 3 due to the polishing traces left on the small test piece 3 in the direction perpendicular to the axial direction thereof can be prevented. Furthermore, frictional heat is prevented from being generated in the direction perpendicular to the axial direction of the small test piece 3, and therefore, deformation of the small test piece 3 due to the frictional heat can also be prevented.

The rotating portion 32 is a portion for rotating the holding portion 31. As shown in FIG. 3, the rotating portion 32 has a motor 32*a* attached beneath the base 2. When the motor 32*a* is rotated, a pair of lower rotating rollers 32*b*, 32*b* is rotated via a speed reducer. This causes a pair of upper rotating rollers 32*c*, 32*c* to rotate synchronously, whereby the holding portion 31 is rotated.

By providing the holding/rotating means 30 as described above, the small test piece 3 can be held firmly and rotated in the firmly held state.

The pressing/scanning means 40 is means for pressing the string-type member 13 against the surface of the small test piece 3 which is held and rotated by the holding/rotating means 30, and performing scanning. As shown in FIG. 3, the pressing/scanning means 40 is made up of a motor 41, a scanning arm 42, and pressure rollers 43.

The scanning arm 42 is a member for performing scanning in the state where the string-type member 13 is pressed against the surface of the small test piece 3. As shown in FIGS. 3 and 4, the scanning arm 42 is made up of a connecting rod 42*a*, an arm body 42*b*, a pair of end arms 42*c*, and a pair of pressure roller mounting arms 42*d*. Further, as shown in FIGS. 3 and 4, the arm body 42*b* is mounted to the connecting rod 42*a*, the end arms 42*c* are mounted to the arm body 42*b*, the pressure roller mounting arms 42*d* are mounted to the end arms 42*c*, and the pressure rollers 43 are mounted to the pressure roller mounting arms 42*d*.

The connecting rod 42*a* converts the rotational motion which is generated by the motor 41 to the linear reciprocating motion, to cause the arm body 42*b* to reciprocate parallel to the axial direction of the small test piece 3. As a result, the end arms 42*c*, the pressure roller mounting arms 42*d*, and the pressure rollers 43 collectively reciprocate, integrally with the arm body 42*b*, parallel to the axial direction of the small test piece 3.

The arm body 42*b* is a member to which the end arms 42*c* are mounted. The arm body 42*b* is in an inverted U shape, as shown in FIG. 4, and its upstream side and downstream side in the traveling direction of the string-type member 13 are symmetrical with respect to the small test piece 3. With this configuration, the pair of end arms 42*c*, the pair of pressure roller mounting arms 42*d*, and the pair of pressure rollers 43 can be symmetrically mounted with respect to the small test piece 3, for reciprocating motion.

The end arm 42*c* is a member to which the pressure roller mounting arm 42*d* is mounted. As shown in FIG. 3, paired end arms 42*c* are mounted to the respective ends of the arm body 42*b*, approximately perpendicular to the base 2. The end arms 42*c* are tilted inwardly toward the small test piece 3 side from the ends of the arm body 42*b*. Such an inwardly tilting shape allows the pair of pressure roller mounting arms 42*d* and the pair of pressure rollers 43 to be arranged closer to the small test piece 3. This can shorten the length of the string-type member 13 from the small test piece 3 to each of the pair of pressure rollers 43, and thus, the string-type member 13 pressed against the small test piece 3 is less likely to suffer slack. Accordingly, the string-type member 13 can be pressed more efficiently. Furthermore, assuming that the distances between the small test piece 3 and the respective pressure rollers 43, i.e., the distances in the Z axis direction, are the same, the isosceles triangle with its apex corresponding to the top of the contact surface between the string-type member 13 and the small test piece 3 and its two sides corresponding to the distances to the respective pressure rollers 43 has a more acute apex angle. This allows the contact area between the string-type member 13 and the small test piece 3 to be increased. Accordingly, the polishing area is increased and, hence, the polishing time is decreased, whereby a very efficient small test piece polishing apparatus 1 can be achieved.

The pressure roller mounting arm 42*d* is a member to which the pressure roller 43 is mounted. As shown in FIG. 4, paired pressure roller mounting arms 42*d* are mounted to the respective end arms 42*c*, to extend in parallel with the axial direction of the small test piece 3. The pressure roller mounting arms 42*d* are located closer to the base 2 than the small test piece 3 is, and the string-type member 13 is configured to pass beneath the pressure rollers 43 on the respective sides of the small test piece 3. This configuration allows the string-type member 13 to press the small test piece 3 downward from above, enabling polishing by the string-type member 13.

Particularly in the case where the string-type member 13 is a thread, when the string-type member 13 presses the small test piece 3 downward from above, the string-type member 13 comes to follow the upper surface of the small test piece 3, rather than contacting the small test piece 3 in a point. In this state, the string-type member 13 is caused to move to and fro in the axial direction of the small test piece 3, while extending perpendicular thereto, for polishing. Accordingly, the area that can be polished is increased and, hence, the time required for polishing is decreased. As a result, a very efficient small test piece polishing apparatus 1 can be achieved.

Further, as the moistened thread is pressed against the small test piece 3 downward from above, the liquid absorbed in the thread is squeezed out onto the upper surface of the small test piece 3. With the small test piece 3 having the circular cross section, the liquid squeezed out onto the upper surface naturally spreads downward along the surface of the small test piece 3. As the small test piece 3 is rotated, and as the string-type member 13 moves on the surface of the small test piece 3 to and fro in the axial direction thereof, the entire surface of the small test piece 3 is covered with the liquid. The liquid functions as a lubricant to enable smooth polishing and, at the same time, it can cool down the frictional heat to prevent deformation of the small test piece 3 due to the frictional heat.

It is noted that the configuration of the scanning arm 42 is not limited to the one as in the present embodiment; it may be as shown in FIG. 5, for example. The small test piece polishing apparatus 1 shown in FIG. 5 differs from the polishing apparatus 1 shown in FIG. 1 in that the configuration of the arm body 42*b* has partially been modified. Members and elements which function similarly are denoted by similar reference characters, and description thereof will not be repeated.

The pressure roller 43 is a member on which the string-type member 13 is passed. As shown in FIG. 4, paired pressure rollers 43 are mounted in such a manner that the line connecting the contact portions of the respective rollers 43 with the string-type member 13 is at a right angle with respect to the axial direction of the small test piece 3. With this configuration, the string-type member 13 for polishing can be pressed against the surface to be polished in the small test piece 3 constantly at a right angle. Thus, the rotation direction of the small test piece 3 at the contact surface with the string-type member 13 can be made identical to the traveling direction of the string-type member 13. This can prevent polishing traces from being left in the direction perpendicular to the axial direction of the small test piece 3, and accordingly, breaks or cracks of the small test piece 3 due to the polishing traces left on the small test piece 3 in the direction perpendicular to the axial direction thereof can be prevented.

Further, it is configured such that the positions of the pair of pressure rollers 43, 43 can be adjusted in the vertical direction in the state where the pressure rollers 43, 43 are attached to the pressure roller mounting arms 42*d*, 42*d*. The positional adjustment of the pressure rollers 43, 43 in the vertical direction enables adjustment of the pressing force applied to the small test piece 3 by the string-type member 13.

As described above, providing the pressing/scanning means 40 ensures efficient polishing of the small test piece 3.

A flow of the processing performed by the small test piece polishing apparatus 1 according to an embodiment of the present invention will now be briefly described with reference to FIG. 2.

Firstly, the string-type member 13 delivered by the delivery portion 11 is moistened in the liquid container 21, and an abrasive is applied to the string-type member 13 in the abrasive container 22. Then, with the small test piece 3 being held and rotated by the holding/rotating means 30, the pressing/scanning means 40 causes the string-type member 13 applied with the abrasive to be pressed against the surface of the small test piece 13 at a right angle with respect to the axial direction thereof and move to and fro in the axial direction in that state, for polishing. The string-type member 13 is then recovered by the recovery portion 12.

As described above, according to the small test piece polishing apparatus of the present invention, the small test piece is polished by the string-type member applied with the abrasive. This enables precise and accurate polishing of the small test piece, and at the same time, prevents bending of or damages to the small test piece. Further, the small test piece can be polished automatically and continuously without the need of manual labor, whereby the working efficiency considerably improves. Furthermore, the small test pieces produced are uniform in quality.

It is noted that the present invention is not limited to the present embodiment, but various suitable modifications are possible. For example, while the liquid container and the abrasive container have been prepared separately for the abrasive applying means for applying the abrasive to the string-type member in the present embodiment, alternatively, the liquid and the abrasive may be mixed in a single container and the abrasive may be applied to the string-type member upstream of the polishing process. Still alternatively, the mixed solution may be dropped down onto the small test piece during the polishing process, to cause the abrasive to be applied to the small test piece and the string-type member. It is of course possible to use an abrasive-impregnated string-type member.

Further, while it has been configured such that the string-type member presses the small test piece downward from above, not limited thereto, it may be configured such that the string-type member presses the small test piece upward from beneath. The scanning direction may also be changed as appropriate.

Furthermore, while all of the end arms and the pressure roller mounting arms have been fixedly secured, not limited thereto, any or all of those arms may be configured to be movable. This configuration allows the arms to be adapted to the material and the shape of the small test piece. It also allows the polishing range as well as the pressing force of the string-type member to be changed as appropriate, so that a single small test piece polishing apparatus can be used for various polishing operations.

Still further, the pressure roller mounting arm may be provided with a spring. With this configuration, the spring biases the oscillating roller, allowing the string-type member to move in accordance with the shape of the small test piece even if the small test piece is bowed or deformed, whereby the small test piece can be polished in accordance with its shape.

What is claimed is:

1. A small test piece polishing apparatus for polishing a surface of a small test piece having a circular cross section using a string-type member, the apparatus comprising:

string-type member delivery/recovery means for delivering and recovering a string-type member;

abrasive applying means for applying an abrasive to the string-type member delivered;

holding/rotating means for holding and rotating a small test piece to be polished; and pressing/scanning means for pressing the string-type member applied with the abrasive against a surface of the small test piece being rotated, to perform scanning.

2. The small test piece polishing apparatus according to claim 1, wherein for applying the abrasive to the string-type member, the abrasive applying means moistens the string-type member before applying the abrasive to the string-type member.

3. The small test piece polishing apparatus according to claim 2, wherein the pressing/scanning means presses the string-type member applied with the abrasive against the small test piece at a right angle with respect to an axial direction of the small test piece, and causes the string-type member applied with the abrasive to move to and fro in the axial direction of the small test piece while being pressed against the small test piece.

4. The small test piece polishing apparatus according to claim 1, wherein the pressing/scanning means presses the string-type member applied with the abrasive against the small test piece at a right angle with respect to an axial direction of the small test piece, and causes the string-type member applied with the abrasive to move to and fro in the axial direction of the small test piece while being pressed against the small test piece.

* * * * *